United States Patent [19]

Akutsu et al.

[11] Patent Number: 4,976,986

[45] Date of Patent: Dec. 11, 1990

[54] INK RECORDING MEDIUM REGENERATING METHOD

[75] Inventors: Eiichi Akutsu; Hiroh Soga; Shigehito Ando, all of Kanagawa, Japan

[73] Assignee: Fuji Xerox Co., Ltd., Tokyo, Japan

[21] Appl. No.: 494,186

[22] Filed: Mar. 15, 1990

[30] Foreign Application Priority Data

| | | | |
|---|---|---|---|
| Mar. 15, 1989 | [JP] | Japan | 1-60622 |
| Mar. 15, 1989 | [JP] | Japan | 1-60623 |
| Mar. 15, 1989 | [JP] | Japan | 1-60624 |

[51] Int. Cl.[5] ..... B05D 1/04

[52] U.S. Cl. ..... 427/27; 427/37; 427/44; 427/49; 427/58; 427/140; 427/141; 427/142; 427/146; 427/359; 427/407.1; 427/428

[58] Field of Search ..... 427/27, 37, 44, 49, 427/58, 140–142, 146, 359, 407.1, 428

*Primary Examiner*—Bernard Pianalto

*Attorney, Agent, or Firm*—Finnegan, Henderson, Farabow, Garrett, and Dunner

[57] ABSTRACT

Disclosed is a method for regenerating an ink recording medium formed by successively laminating an anisotropic electrically conductive layer, a heating resistor layer for generating heat in response to application of an electric signal, an electrically conductive layer, an ink parting layer, and a heat-melting ink layer, in which the heat-melting ink layer after print-recording with the ink recording medium is regenerated by use of ink particles containing a binding resin and a coloring agent, the improvement is in that by use of the ink recording medium further including an ink parting layer having a thickness of 0.08 to 3 μm, and a volume resistivity of $10^8$ Ω cm or more, the heat-melting ink layer after print-recording with the ink recording medium is electrified with the same polarity as the potential of electrified ink particles, and then the ink particles carried by an ink carrier is deposited on traces of transferred ink formed in the heat-melting ink layer. According to the method, therefore, ink particles can be prevented from depositing onto an untransferred portion of the heat-melting ink layer of the ink recording medium, so that a difference in ink layer thickness between the ink transferred portion (traces of transferred ink) and the untransferred portion can be reduced to thereby make it possible to obtain good printed images even in the case of repeated use for a long term.

9 Claims, 6 Drawing Sheets

INK RECORDING MEDIUM REGENERATING METHOD

BACKGROUND OF THE INVENTION

1. Field of the Invention

The present invention relates to a method for regenerating an ink recording medium for use in a print-recording method in which an electric signal is converted into heat energy to transfer an ink image to a transfer materiel to thereby perform a print-recording.

2. Description of the Prior Art

Heretofore, as an electrically energizing thermal transfer recording method, there has been known a method for performing print-recording by using an ink recording medium prepared by providing a heat-melting ink layer on a print-recording ink carrier formed by successively laminating an anisotropic electrically conductive layer, a heating resistor layer for generating heat in response to the input of an electric signal corresponding to a picture signal and an electrically conductive layer. In the method, the ink recording medium is used repeatedly by supplying powder ink onto traces of transferred ink in the heat-melting ink layer after the print-recording, thereby regenerating the heat-melting ink layer.

As conventional print-recording apparatus, those shown in FIGS. 1 and 2 are known. In FIGS. 1 and 2, an ink recording medium 1 is fed in the direction of the arrow by means of a pair of feed rolls 6. Heat-melting ink is transferred to a transfer material 3 on a back-surface pressing roll 4 in response to an electric signal generated from a print-recording head disposed in a printing portion so that print-recording is carried out. An electric current is grounded through a return-circuit contact roll 5. Then, the ink recording medium reaches a powder ink supply unit 7, in which powder ink is supplied. Further, in an ink surface-shaping unit 8, the surface of the heat melting ink layer is shaped up so that both reproduction of the ink recording medium and preparation for a next print-recording operation are perfected.

In the conventional print-recording method, powder ink is deposited not only on an ink-transferred portion (traces of transferred ink) having no powder ink but also on an untransferred portion having remaining powder ink, in the heat-melting ink layer of the ink recording medium, when the ink recording medium is regenerated. There arises a disadvantage in that the thickness of the heat-melting ink layer varies widely according to the locations. As a result, a problem exists in that the recording ink medium cannot be used repeatedly for a long time. Further, in the conventional print-recording method, the surface of the heat-melting ink layer is shaped by uniting powder ink with the heat-melting ink layer into one body through melting powder ink while pressing a heat-roll-type surface-shaping roll onto a surface of the heat-melting ink layer carrying powder ink supplied in the ink supply unit. However, a considerably long waiting time is required for heating the surface of the surface-shaping roll to a sufficient temperature to melt the heat-melting ink. Further, a special means for heating the surface-shaping roll is required. Accordingly, the conventional method is not sufficient in point of efficiency in energy required for melting the heat-melting ink.

SUMMARY OF THE INVENTION

An object of the present invention is to provide a method for regenerating an ink recording medium, in which a heat-melting ink layer in the ink recording medium can be regenerated well while ink particles are prevented from depositing on an untransferred portion of the heat-melting ink layer of the ink recording medium.

In order to attain the above object, according to an aspect of the present invention, in the method for regenerating an ink recording medium formed by successively laminating an anisotropic electrically conductive layer, a heating resistor layer for generating heat in response to application of an electric signal, an electrically conductive layer, an ink parting layer, and a heat-melting ink layer, in which the heat-melting ink layer after print-recording with the ink recording medium is regenerated by use of ink particles containing a binding resin and a coloring agent, the improvement is in that by use of the ink recording medium including the ink parting layer having a thickness of 0.08 to 3 $\mu$m and a volume resistivity of $10^8$ $\Omega$ cm or more, the heat-melting ink layer after print-recording with the ink recording medium is electrified with the same polarity as the potential of electrified ink particles, and then the ink particles carried by an ink carrier is deposited on traces of transferred ink formed in the heat-melting ink layer.

The ink particles to be used for regeneration according to the present invention may be powder ink particles or may be dispersion ink particles dispersed in a liquid carrier. In the case of using powder ink, the ink carrier can be suitably selected from an electrically conductive carrier formed of iron powder or the like, and a carrier coated with synthetic resin.

Another object of the present invention is to provide a method for shaping the surface of a heat-melting ink layer in an ink recording medium, in which the surface of the heat-melting layer can be shaped well when the ink recording medium is regenerated.

In order to attain the above object, according to another aspect of the present invention, in the method for regenerating an ink recording medium formed by successively laminating an anisotropic electrically conductive layer, a heating resistor layer for generating heat in response to the input of an electric signal, an electrically conductive layer, an ink parting layer, and a heat-melting ink layer, in which the heat-melting ink layer after print-recording with the ink recording medium is regenerated by use of heat-melting ink particles, the improvement is in that after heat-melting ink powder is applied onto the ink parting layer of the ink recording medium, an electrically energizing means is brought into contact with the anisotropic electrically conductive layer of the ink recording medium over the whole width thereof to apply a voltage and pressure between the electrically energizing means and the electrically conductive layer of the ink recording medium to thereby shape the surface of the heat-melting ink layer.

A further object of the present invention is to provide a method for supplying heat-melting ink powder, in which heat-melting ink powder can be supplied stably onto a print-recording ink carrier.

In order to attain the above object, according to a further aspect of the present invention, the method for supplying heat-melting ink powder has a feature in that a print-recording ink carrier formed by successively laminating an anisotropic electrically conductive layer, a heating resistor layer for generating heat in response to the input of an electric signal, an electrically conductive layer, and an ink parting layer having a volume resistivity of $10^8$ Ω cm or more and a thickness of 0.08 to 3.0 μm is made to face a supply ink carrier carrying insulating heat-melting ink powder on its surface so that the ink parting layer of the print-recording ink carrier comes into close or direct contact with the supply ink carrier, and then a voltage is applied between the conductive layer of the print-recording ink carrier and the supply ink carrier to thereby transfer the heat-melting ink powder onto the ink parting layer.

DETAILED DESCRIPTION OF THE PREFERRED EMBODIMENTS

Figure 1:
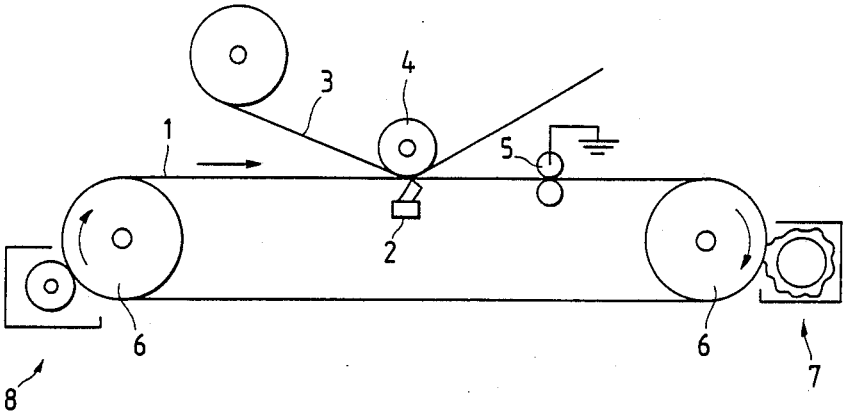
FIG. 1 PRIOR ART
FIGS. 1 and 2 are diagramatical views each showing an example of the conventional print-recording apparatus.
Figure 2:
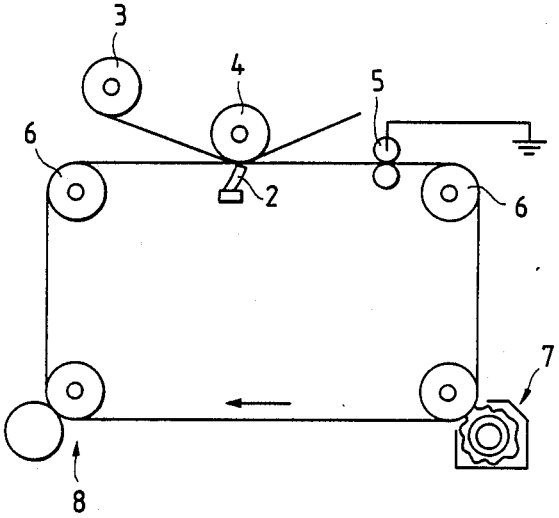
FIG. 2 PRIOR ART

The ink recording medium to be used according to the present invention will be described first.

The anisotropic electrically conductive layer serves to reduce electric loss caused by electric resistance at the time of energization with electricity in the direction of thickness and also to reduce heat loss and heat damage caused by contacting resistance between a needle electrode and a surface of an ink recording medium. The anisotropic electrically conductive layer may be an isolated conductor pattern layer constituted by fine isolated electrodes. Each of the fine isolated electrodes may be shaped like a circle or may be shaped like a rectangle. Alternatively the anisotropic electrically conductive layer may be a layer prepared by forming electrically conductive paths made of an electrically conductive matter, such as metallic powder, electrically conductive ceramics, or the like, in an insulating material, such as ceramics, synthetic resin, or the like.

In the case where the anisotropic electrically conductive layer in the thermal transfer-recording medium used in the present invention is an isolated conductor pattern layer, the heating resistor layer is provided to serve as a support. In the case where it is not an isolated conductor pattern layer, the anisotropic electrically conductive layer is provided so as to serve as a support and so as to have a thin-film heating resistor layer on its one surface.

The heating resistor layer serves to convert an electric current obtained from the anisotropic electrically conductive layer into Joule heat to thereby generate heat, melt ink and transfer the melted ink to a transfer material. Examples of the heating resistor layer are an electrically conductive layer formed by dispersing an electrically conductive matter, such as carbon, metallic powder, or the like, in heat-resistant resin (such as polyimide resin, polyimide-amide resin, silicone resin, fluororesin, epoxy resin, or the like), and a thin-film layer prepared by using a high resistance material, such as $ZrO_2$, $Al_2O_3$, $SiO_2$, or the like, and an electrically conductive material, such as Ti, Al, Ta, Cu, Au, Zr, or the like. The volume resistivity of the heating resistor layer is preferably established to be within a range of $10^{-2}$ to $10^2$ Ω cm. The thickness of the heating resistor layer is preferably established to be within a range of 1000Å to 500 μm. When these factors are respectively within the aforementioned ranges, the heating resistor layer is excellent in film-forming stability, film adhesion, and the like.

The electrically conductive layer serves as an electrode for diffusing an electric current flowing into the heating resistor layer and for circulating the current. This layer is preferably prepared by depositing a metal, such as Al, or the like, or electrically conductive ceramics by using an evaporating deposition method, a sputtering method or other thin-film forming methods so that the layer can have surface resistivity of 50 Ω/□ or less. The thickness of the layer is preferably established to be within a range of 500 Å to 5 μm. It is more preferable from the viewpoint of heat leakage and necessary electrically conductive characteristic that the thickness is established to be within a range of 1000Å to 2000Å.

The ink parting layer is a layer adjusted to have a critical surface tension suitable so that ink transfer can be performed well even with low printing energy. In other words, the layer is constituted by a thin film having a function of low surface energy. Basically, this layer has a critical surface tension lower than the surface energy of the transfer material. Preferably, the critical surface tension is 38 dyne/cm or less. Further, it is desired that the ink parting layer has heat resistance, that is, has a melting point of 180° C. or more.

It is necessary that the ink parting layer to be used in accordance with the present invention has a thickness of 0.08 μm to 3 μm and a volume resistivity of $10^8$ Ω cm or more. Examples of the material to be used for constituting the ink parting layer are thermosetting silicone resin, fluororesin, and the like.

The heat-melting ink layer provided on the ink parting layer is prepared by dispersing known dyes or pigments, such as carbon black, in thermoplastic resin having a melting point of 140° C. or less. The thickness of the heat-melting ink layer is established to be, preferably, within a range of 4 μm to 15 μm, more preferably, within a range of 3 μm to 10 μm.

On the other hand, the heat-melting ink particles to be used for regenerating the heat-melting ink layer are preferably provided to have the same composition as that of the heat-melting ink layer.

EMBODIMENT I

Figure 3:
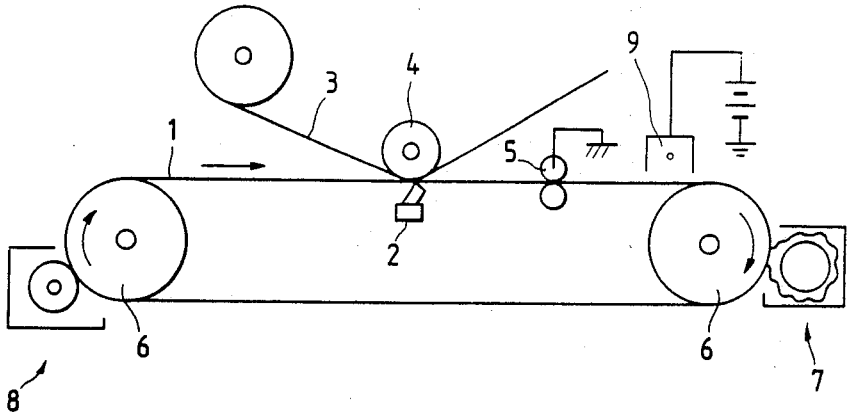
FIGS. 3 through 5 are views for explaining a first embodiment of the present invention, FIG. 3 being a diagramatical view of a print-recording apparatus, FIG. 4 being a diagramatical view showing another example of an ink recording medium, FIG. 5 being an explanatory view showing a state of electrification by corona discharge according to the present invention.
Figure 4:
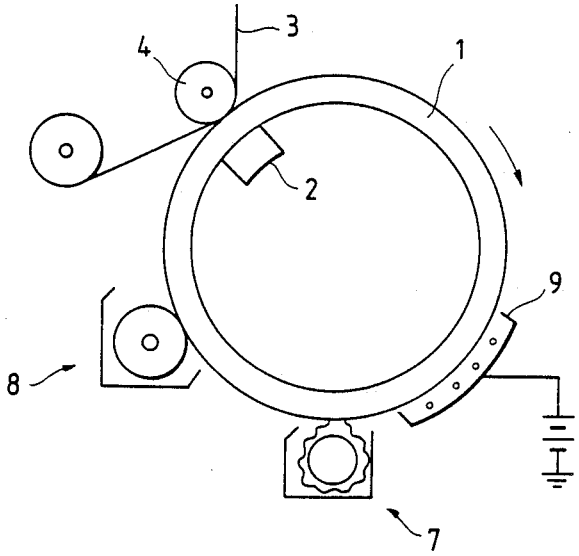
Figure 5:
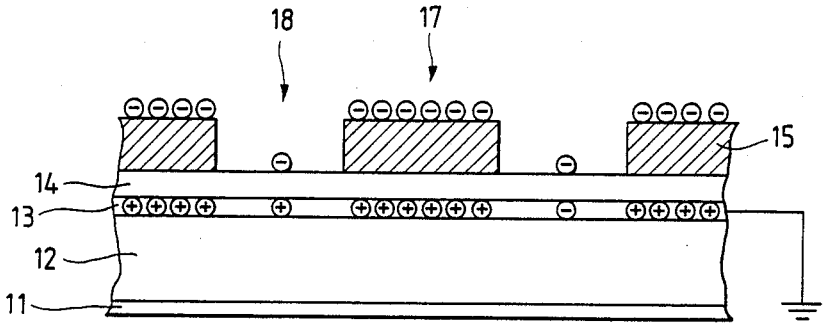

FIG. 3 is a schematic view of a print-recording apparatus for explaining a first embodiment of the present invention, FIG. 4 is a view showing another example of an ink recording medium, and FIG. 5 is an explanatory view showing a state of corona electrification.

In FIG. 3, the reference numeral 1 designates an ink recording medium which is, as shown in FIG. 5, composed of an anisotropic electrically conductive layer 11, a heating resistor layer 12, an electrically conductive layer 13, an ink parting layer 14, and a heat-melting ink layer 15.

The reference numeral 2 designates a print-recording head capable of sliding on a surface of the anisotropic electrically conductive layer of the ink recording medium. The reference numeral 3 designates a transfer material which is brought into forced contact with the heat-melting ink layer 15 of the ink recording medium by a back-surface pressing roll 4. The reference numeral 5 designates a return-circuit contact roll which is arranged to be in contact with the electrically conductive portion of the print-recording medium exposed at the side end of the former. The reference numeral 6 designates a pair of feed rolls for feeding the ink recording medium. The reference numeral 7 designates a powder ink supply unit. The reference numeral 8 designates an ink layer surface-shaping unit. The reference numeral 9 designates a corona electrifier for electrifying the heat-melting ink layer.

In the print-recording apparatus having the aforementioned structure, the ink recording medium 1 is fed to a print-recording portion by the pair of feed rolls 6. The heat-melting ink layer 15 is transferred to the transfer material 3 in response to a signal current generated from the print-recording head 2, so that print-recording is carried out. After the print-recording, the ink recording medium 1 is electrified by the corona electrifier 9 while the polarity of the heat-melting ink layer 15 is adjusted to be the same as that of electrified powder ink. Then, the ink recording medium 1 reaches the powder ink supply unit 7, so that powder ink carried by the ink carrier is deposited onto traces of transferred ink in the heat-melting ink layer 15. For example, the powder ink supply unit is constituted by a powder ink feed roll having an electrically conductive sleeve, so that powder ink deposited on the powder ink feed roll is fed and deposited onto the traces of transferred ink in the heat-melting ink layer. In that case, it is preferable that a bias voltage of 100 to 500 V is applied to the electrically conductive sleeve with the same polarity as that of electrified ink powder.

Then, the ink recording medium 1 is heated and pressed in the ink layer surface-shaping unit 8 to thereby perform the regeneration of the heat-melting ink layer 15.

In FIG. 4, the ink recording medium 1 forms a cylindrical drum. The ink recording medium 1 is rotated in the direction of the arrow by a drive unit not shown so that print-recording is carried out on the transfer material in response to the signal current from the print-recording head 2 in the same manner as in FIG. 3. Then, the heat-melting ink layer 15 is electrified by the corona electrifier 9, and, then, the surface of the layer is shaped by the powder ink supply unit 7 and the ink layer surface-shaping unit 8, so that the heat-melting ink layer is regenerated.

In this embodiment, the heat-melting ink layer 15 of the ink recording medium 1 is electrified by the corona electrifier 9 after the print-recording as described above. In this case, the electrically conductive layer 13 of the ink recording medium 1 serves as a counter electrode to be kept in the ground potential. Further, the ink parting layer 14 has a thickness of 1 μm or less and a volume resistivity of $10^8$ Ω cm or more. Accordingly, the transferred portion 16 (traces of transferred ink) of the heat-meting ink layer 15 is little electrified by corona discharge as shown in FIG. 5. In other words, the untransferred portion 17 of the heat-melting ink layer 15 is selectively efficiently electrified to high potential because the ink recording medium has a uniform electrically conductive layer. Because the polarity of the electrified potential thereof is the same as that of charged ink particles, the charged ink particles repel electric charges of the untransferred portion 17 to thereby prevent ink deposition on the untransferred portion. On the other hand, the transferred portion 16 (traces of transferred ink) is in a state in which the electrically conductive layer is coated with the thin-film ink parting layer. Accordingly, Coulomb force necessary for deposition is produced between the electrically conductive layer in the ink recording medium and the ink powder. Consequently, charged ink particles are deposited on the traces of transferred ink.

EMBODIMENT I-1

A 6000Å-thick Cr layer was formed by applying Cr to one surface of an electrically conductive polyimide film having surface resistivity of 550 Ω/□ and a thickness of 40 μm by a high-frequency sputtering film-forming method. Then, a photo-resist was formed on the Cr layer and then subjected to a pre-baking process at 90° C. for eight minutes to thereby prepare a 1.2 μm-thick resist film. The resist film was exposed to light through a mask having 16 μm-round polka dots at intervals of a pitch 20 μm on its whole surface, developed, washed with water and then heated at 120° C. for 15 minutes in an oven under an $N_2$ atmosphere to thereby be hardened. Then, etching was carried out by using hydrochloric acid to remove the Cr layer partly from a portion not covered with the photo-resist film. Then, the layer was subjected to an acetone bath and washed well with ultrasonic wave to remove the resist film. Thus, an anisotropic electrically conductive layer having a pattern of 16 μm-round polka dots at intervals of a pitch 20 μm on its whole one-side surface was prepared.

Then, a 1000Å-thick electrically conductive layer (0.2 Ω/□) was formed by applying Al to the other surface of the electrically conductive polyimide film by the high-frequency sputtering film-forming method. Thermosetting silicone hard-coat resin ($10^{15}$ Ω cm) was applied onto the Al layer and hardened by heating at 180° C. for one hour to thereby prepare an ink parting layer having a critical surface tension of 30 dyne/cm and a thickness of 0.2 μm. In the application of the resin, the ink parting layer was not formed in opposite belt ends of the film in order to provide a return-circuit contact therein.

The film-shaped matter thus prepared was connected while the anisotropic electrically conductive layer being turned inward, to thereby prepare an endless belt.

Then, a 6 μm-thick coloring heat-melting ink layer mainly containing thermoplastic resin having a melting point of 80° C. was provided on the ink parting layer to thereby prepare an ink recording medium.

The ink recording medium was mounted on a print-recording apparatus as shown in FIG. 3 to carry out the following test.

The return-circuit contact portion of the electrode layer was grounded. The endless-belt-like ink recording medium was moved at a speed of 50 mm/sec under application of pressure of 800 g/cm and a signal current from a 210 mm-wide stylus head having a head portion 200SPI (125 μm pitch and 60 μm□ electrode) to carry out print-recording.

After the print-recording, the ink recording medium was subjected to corona discharge under the condition of a corona voltage of −7 KV by means of a corona electrifier having an aperture width of 25 mm while adjusting the polarity to be the same as that of powder ink.

Then, powder ink was deposited on the print-recording medium in the ink supply unit. An 80 mm-diameter magnet roll having an aluminum sleeve was used as a powder ink feed roll. A 10 mm-diameter bias voltage application aluminum roll was provided on one end of the powder ink feed roll. Powder ink with a mean particle diameter of 130 μm and $\sigma=5.1$ μm was prepared by dispersing 10% of pigment in low-molecular polyester resin (melting point: 97° C., glass transition point: 58° C.). A coating magnetic carrier with a mean particle diameter of 130 μm was mixed with the powder ink in an amount of 96% by weight per weight of the powder ink while stirring well by using the magnet powder feed roll. A powder ink regenerative magnetic brush constituted by a mixture of the powder ink and the coating carrier was brought into contact with the surface of the ink recording medium by using the powder ink feed roll. At that time, the heat-melting ink layer of the ink recording medium was regenerated while the quantity of deposited powder ink was controlled by applying a bias voltage of −500 V to the sleeve of the powder ink feed roll.

Then, powder ink was temporally fixed by application of heat and pressure to the ink recording medium through the ink surface-shaping unit.

The aforementioned series of procedure for print-recording and regenerating the heat-melting ink layer was repeated by 10,000 times. As a result, it was confirmed that the optical reflection concentration of the solid printing image portion was within a range of ±0.3.

COMPARATIVE EXAMPLE I-a

Print-recording and regeneration of the heat-melting ink layer were carried out by using the same ink recording medium and in the same manner as in Embodiment I-1, except that corona discharge after the print-recording was not carried out in the Comparative Example. The series of procedure for print-recording and regenerating the heat-melting ink layer was repeated. As a result, the heat-melting ink layer was thickened. Furthermore, difference in ink layer thickness between the ink-transferred portion and the untransferred portion was enlarged, so that broken transfer characters appeared at 130-time repetition, and, further, ink transfer was almost spoiled at 300-time repetition.

COMPARATIVE EXAMPLE I-b

Print-recording and regeneration of the heat-melting ink layer were carried out by using the same ink recording medium and in the same manner as in Embodiment I-1, except that the ink parting layer provided in Embodiment I-1 was not provided in the ink recording medium in the Comparative Example. As a result, a large number of broken narrow lines appeared in the first-time print-recording image, and, further, the quality of the image was poor. After the second time, the deposition of regenerative powder ink was so uneven that the remaining of the heat-melting ink layer occurred in a state of ink transfer at the time of transfer. Accordingly, reliability on regeneration was very low. Furthermore, the Al layer as an electrically conductive layer was gradually worn away by contact with the powder ink magnet brush, so that the silver white color of Al disappeared from the ink recording medium at 500-time repetition.

COMPARATIVE EXAMPLE I-c

Print-recording and regeneration of the heat-melting ink layer were carried out by using the same ink recording medium and in the same manner as in Embodiment I-1, except that the thickness of the ink parting layer was established to be 10 μm in the Comparative Example.

In the Comparative Example, printing energy twice as much as that in Embodiment I-1 was required for attaining printing dots of the same diameter as in Embodiment I-1. Furthermore, the change of the resistance value of 5% occurred at 5000-time repetition which exhibited that the pulse-resistance lifetime of the print-recording medium was reduced to one-eighth. In addition, electrification by corona discharge after the print-recording was so poor that the heat-melting ink layer could not be regenerated sufficiently.

COMPARATIVE EXAMPLE I-d

Print-recording and regeneration of the heat-melting ink layer were carried out by using the same ink recording medium and in the same manner as in Embodiment I-1 except that the thickness of the ink parting layer was established to be 0.02 μm in this Comparative Example.

In this Comparative Example, a large number of pinholes occurred in the ink parting layer. Further, irregularity of ink transfer occurred so that the same phenomenon as in Comparative Example I-b was observed.

EMBODIMENT I-2

A 100 μm-thick 120 mm-diameter Al cylinder having a sodium hydroxide aqueous solution of pH 10 being put in the inside thereof was set into a ultrasonic cleaning tank. Ultrasonic wave was applied to the Al cylinder for 10 seconds, so that thus cleaning of the inner surface of the Al cylinder and pre-treatment were carried out. Then, an aqueous solution containing 4% by volume of phosphoric acid as an electrolytic solution was put in the inside of the Al cylinder. A 10 mm-diameter platinum bar connected to the negative terminal of a DC electric source was grounded at the center portion of the Al cylinder. The Al cylinder was connected to the positive electrode of the DC electric source. An electric current was passed between the two electrodes under the condition of current density of 60 A/dm$^2$ and liquid temperature of 20° C. for 150 minutes. Thus, alumina treatment was finished.

Then, an electrolytic solution containing nickel salts was put in the inside of the Al cylinder after the inside thereof was subjected to the alumina treatment. Alternating-current electrolysis was carried out with the Al cylinder as one electrode and with the platinum bar as a counter electrode under the condition of current density of 30 A/dm$^2$ for 100 minutes to precipitate nickel in pores formed in the alumina coating. The Al cylinder treated as described above was immersed in a liquid mixture of phosphoric acid, nitric acid and water in the weight proportion 4:2:3 and left under ultrasonic wave for 180 seconds. Al was removed by that treatment to thereby prepare a cylindrical endless belt of alumina having stripe-like nickel electrically conductive portions in the direction of thickness.

A target consisting of mixture of BN, Ta and $SiO_2$ was applied to the thus prepared endless belt by the high-frequency sputtering method under the condition of temperature of 580° C. and Ar gas of $10^{-3}$ Torr to prepare a 0.5 μm-thick film in the outside of the endless belt. Then, Al was applied to the aforementioned film at room temperature by a vacuum evaporating deposition method to prepare a 1500Å-thick electrically conductive layer. Then, a dimethylsiloxane solution was applied onto the thus prepared Al layer. The resulting Al layer was dried and then hardened by heating at 200° C. for 3 minutes to prepare a 0.2 μm-thick ink parting layer having a critical surface tension of 33 dyne/cm. A 4 μm-thick ink layer prepared by dispersing 7% by weight of phthalocyanine pigment in polyester base resin having a melting point of 99° C. was provided on the ink parting layer to form a heat-sensitive ink layer. Thus, a drum-like ink recording medium was prepared.

Then, as shown in FIG. 4, the drum-like ink recording medium was set in a unit having a corona electrifier to carry out a print-recording. The same procedure as in Embodiment I-1 was carried out under the condition of a corona voltage of −8 KV, 4 wires, an aperture width of 60 μm and a drum linear speed or velocity of 350 mm/second to deposit powder ink on the heat-melting ink layer. Then, the surface of the ink layer was shaped by the ink surface-shaping roll under the condition of surface temperature of 135° C. and compression pressure of 2 kg/cm.

The series of procedure for print-recording and regenerating the heat-melting ink layer was repeated. As a result, 40,000 copies excellent in picture quality were obtained.

In this embodiment, the heat-melting ink layer of the ink recording medium is electrified by corona discharge while adjusting the polarity to be the same as that of ink particles used for regeneration, after the print-recording. Then, regeneration was carried out by using ink particles carried by the ink carrier. Accordingly, ink particles can be effectively deposited on traces of transferred ink in the heat-melting ink layer, and, on the other hand, ink particles can be prevented from depositing onto the untransferred portion.

Accordingly, difference in ink layer thickness between the ink-transferred portion and the untransferred portion was reduced, so that good printing images can be attained in spite of repeated use for a long term.

EMBODIMENT II

Figure 6:
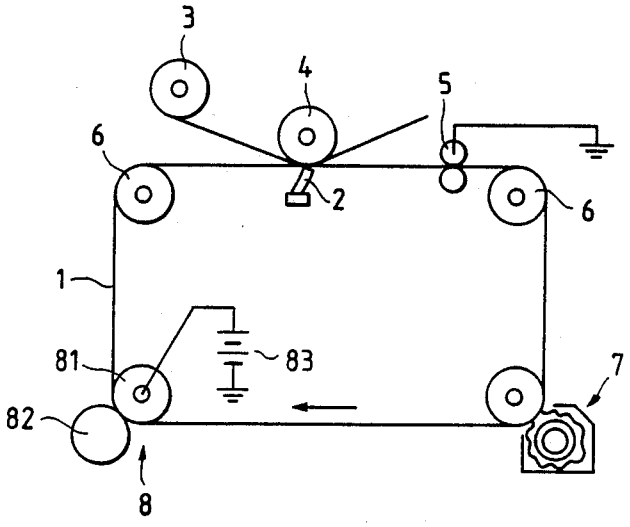
FIGS. 6 through 9 are views for explaining a second embodiment of the present invention, FIG. 6 being a diagramatical view of a print-recording apparatus, FIG. 7 being a structural view showing another example of an ink layer surface-shaping means, FIG. 8 being a structural view showing a further example of an ink layer surface-shaping means, FIG. 9 being a perspective view of an ink recording medium used in this embodiment.
Figure 9:
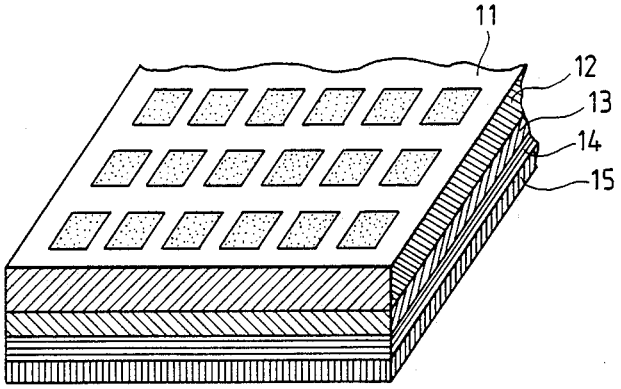

FIG. 6 is a diagramatical view of a print-recording apparatus using a second embodiment of the regenerating method according to the present invention. In FIG. 6 the reference numeral 1 designates an ink recording medium which is, as shown in FIG. 9, composed of an anisotropic electrically conductive layer 11, a heating resistor layer 12, an electrically conductive layer 13, an ink parting layer 14, and a heat-melting ink layer 15. In this second embodiment, items corresponding to those in the first embodiment are referenced correspondingly and the description about them is omitted here.

In FIG. 6, the ink layer surface-shaping unit 8 is constituted by an ink layer surface-shaping means. For example, the ink layer surface-shaping means is composed of a heat surface-shaping roll 81 rotating while supporting the ink recording medium, and a back-surface pressing roll 82 provided in opposition to the roll 81. An electric source 83 for voltage application is connected to the heat surface-shaping roll.

In the print-recording apparatus having the aforementioned structure, the ink recording medium 1 is fed to a print-recording portion by the pair of feed rolls 6. The heat-melting ink layer 15 is transferred to the transfer material 3 in response to a signal current generated from the print-recording head 2, so that print-recording is carried out. After the print-recording, the ink recording medium 1 reaches the powder ink supply unit 7, so that powder ink is supplied.

Then, the ink recording medium 1 reaches the ink layer surface-shaping unit 8. In the ink layer surface-shaping unit 8, a predetermined voltage is applied between the electrode roll 81 and the electrically conductive layer 13 of the ink recording medium 1 so that a current flows in the heating resistor layer 12 and heat as Joule heat is generated to melt the heat-melting ink layer 15 and deposited powder ink to thereby shape the surface of ink.

Figure 7:
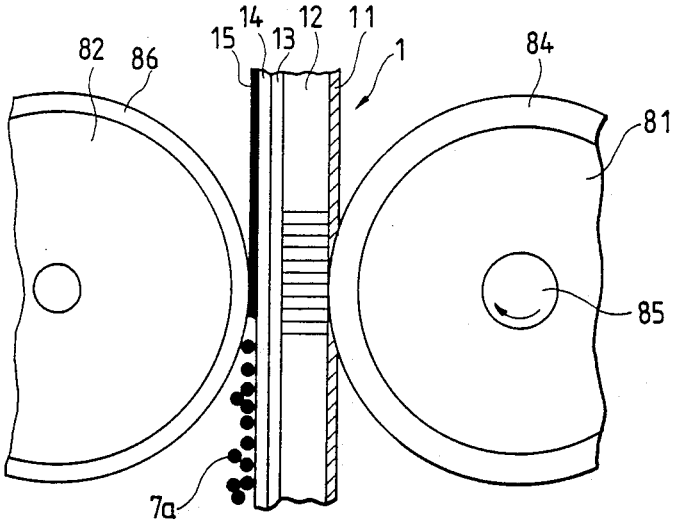

FIG. 7 shows another example of the ink layer surface-shaping means. The ink layer surface means is composed of a heat surface-shaping electrode roll 81 having an electrically conductive layer 84 on its surface and supported by a drive shaft 85, and a back-surface pressing roll 82 having a low surface energy layer 86 on its surface. The rolls 81 and 82 are provided opposite to each other so that the ink recording medium 1 can be passed between the rolls.

In this example, a predetermined voltage is applied between the electrically conductive layer 84 of the heat surface-shaping electrode roll 81 and the electrically conductive layer 13 of the ink recording medium 1. Accordingly, a current is passed between the anisotropic electrically conductive layer 11 at a portion being in contact with the heat surface-shaping electrode roll 81 and the electrically conductive layer 13, so that Joule heat is generated in the heating resistor layer 12 to soften or melt powder ink 7*a* on the ink parting layer 14. Further, the surface-shaped heat-melt ink layer 15 is formed efficiently because of application of pressure of the back-surface pressing roll 82.

Figure 8:
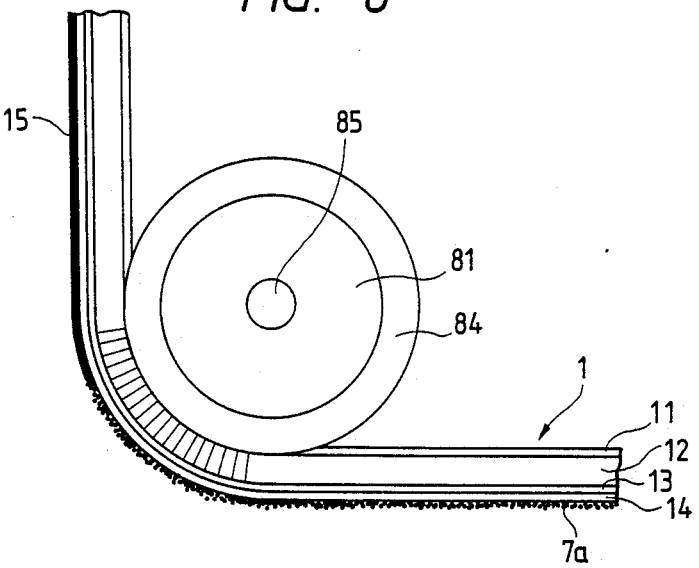

FIG. 8 shows a further example of the ink layer surface-shaping means. In this example, the ink recording medium 1 is conveyed while being in contact with a wide surface area of the heat surface-shaping roll 81 having an electrically conductive layer 84 on its surface and supported by a drive shaft 85.

Also in this example, a predetermined voltage is applied between the electrically conductive layer 84 of the heat surface-shaping electrode roll 81 and the electrically conductive layer 13 of the ink recording medium 1. Accordingly, a current is passed between the anisotropic electrically conductive layer 11 at a portion being in contact with the heat surface-shaping electrode roll 81 and the electrically conductive layer 13 so that Joule heat is generated in the heating resistor layer 12 to soften or melt powder ink 7*a* on the ink parting layer 14. Thus, the surface-shaped heat-melt ink layer 15 is formed.

EMBODIMENT II-1

A 5000Å-thick Ti layer was formed by applying Ti to one surface of an electrically conductive polyimide film having surface resistivity of 600 Ω/□ and a thickness of 30 μm by a high-frequency sputtering film-forming method. Then, a photo-resist was formed on the Ti layer and dried at 90° C. for 8 minutes to thereby prepare a 1.6 μm-thick resist film. The resist film was exposed to light through a mask having a pattern of 15 μm-square polka dots at intervals of a pitch 25 μm on its whole surface, developed and then heated at 110° C. for 15 minutes in an oven under an $N_2$ atmosphere to thereby be hardened. Then, reactive ion etching was carried out to remove the Ti layer partly from a portion not covered with the photo-resist film. Then, the resulting film was subjected to ultrasonic wave in an acetone tank to remove the resist film. Thus, an anisotropic electrically conductive layer having an electrically conductive pattern was prepared.

Then, a 1000Å-thick electrically conductive layer was formed by applying Al to the other surface of the electrically conductive polyimide film by the high-frequency sputtering film-forming method.

Then, thermosetting silicone resin was applied onto the electrically conductive layer except the return-circuit electrode contact portion thereof and hardened by heating at 150° C. for one hour to thereby prepare an ink parting layer having a critical surface tension of 32 dyne/cm, a heat-resisting temperature of 380° C. and a thickness of 0.3 μm.

The film-shaped matter thus prepared was stuck while the anisotropic electrically conductive layer being turned inward to thereby to prepare an endless belt to be used as a print-recording ink carrier.

Then, powder ink with a mean particle diameter of 8.2 μm containing 6% by weight of electrically conductive carbon pigment in low-molecular polyester resin having a melting point of 101° C. and a critical surface tension of 43 dyne/cm was mixed with a coating carrier with a mean particle diameter of 90 μm so that powder ink was electrified by friction. The mixture of the powder ink and the coating carrier was deposited by the phenomenon of electrodeposition by using a powder ink feed roll having a bar-like magnet in its inside to form substantially one layer on the ink parting layer of the print-recording ink carrier.

Then, the surface of ink was shaped by an ink layer surface-shaping means as shown in FIG. 7. In short, a 45 mm-diameter SUS304 roll was used as a heat surface-shaping electrode roll. A 4 mm-thick 45 mm-diameter aluminum roll having a 25 μm-thick coating film made of tetrafluoroethylene having a critical surface tension of 18 dyne/cm in its surface was used as a back-surface pressing roll. The rolls were arranged opposite to each other. The print-recording ink carrier having the deposited powder ink was passed between the rolls while the anisotropic electrically conductive layer thereof was in contact with the heat surface-shaping electrode roll. In the passing of the ink carrier, pressure of 1.5 kg/cm was applied to the print-recording ink carrier through the back-surface pressing roll. Further, a voltage of 6 V was applied between the heat surface-shaping roll and the electrically conductive layer of the print-recording ink carrier. As a result of the electrically energization, the heating resistor layer of the print-recording ink carrier generated heat to thereby soften the powder ink. Thus, the shaping of the surface of the heat-melting ink layer was perfected. The surface roughness of the heat-melting ink layer became Ra=0.2 μm and the mean thickness thereof became 5.2 μm.

Consequently, good print-recording could be carried out by repeating the aforementioned series of procedure.

EMBODIMENT II-2

After powder ink was deposited on the print-recording ink medium prepared in Embodiment II-1, the surface of ink was shaped by using an ink layer surface-shaping means as shown in FIG. 8. That is, a 30 mm-diameter aluminum roll having a 6000Å-thick tantalum coating layer was used as a heat surface-shaping electrode roll. A voltage of 8 V was applied between the tantalum coating layer and the electrically conductive layer of the print- recording ink carrier while the roll was rotated at the same linear speed as that of the print-recording ink carrier. A current was therefore passed in the direction of the thickness of the heating resistor layer of the print-recording ink carrier to generate Joule heat to thereby heat the powder ink. Thus, the heat-melting ink layer having its surface shaped up was formed. At that time, the surface roughness of the heat-melting ink layer was Ra=0.4 &Lm and the (mean) thickness thereof was 6.3 &Lm.

In the case where print-recording was carried out by using the heat-melting ink layer having its surface shaped up as described above, good printing could be attained on transfer paper.

COMPARATIVE EXAMPLE II-2

After powder ink was deposited on the print-recording ink medium prepared in Embodiment II-1, the surface of ink was shaped as follows. That is, a heat lamp was provided in the center of a 210 mm-wide back-surface pressing roll prepared in the same manner as in Embodiment II-1. The shaping of the ink surface was carried out by turning on the heat lamp. In this comparative example, no voltage was applied to the heat surface-shaping roll. As a result, the surface roughness of the heat-melting ink layer was Ra=0.5 μm. The consumption of power in the heat lamp was 2.5 times as much as the input power of the heat surface-shaping electrode roll calculated in Embodiment II-1.

This embodiment has the following advantages:

(1) Because heating energy efficiency is good, the shaping of the ink surface can be made by a small quantity of energy which is half or less the energy used in the conventional heat-roll-type surface-shaping roll;

(2) Because the heating resistor layer of the ink recording medium is used for heating, no special heating means is not required so that there arises an advantage in the point of view of reliability and producibility; and (3) The waiting time conventionally required for shaping the ink surface is not required.

EMBODIMENT III

Figure 10:
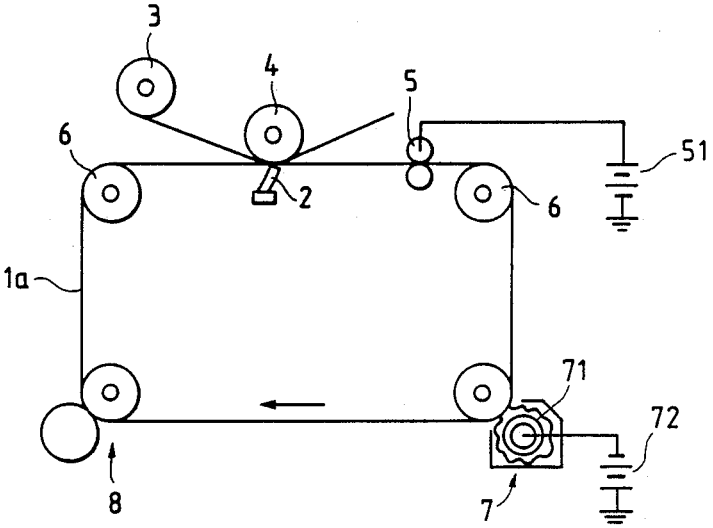
FIGS. 10 through 12 are views for explaining a third embodiment of the present invention, FIG. 10 being a diagramatical view of a print-recording apparatus, FIG. 11 being an explanatory view showing a state in which heat-sensitive ink powder is deposited on a print-recording ink carrier, FIG. 12 being an explanatory view showing a state in which heat-sensitive ink powder is deposited on traces of transferred ink in a heat-sensitive ink layer.
Figure 11:
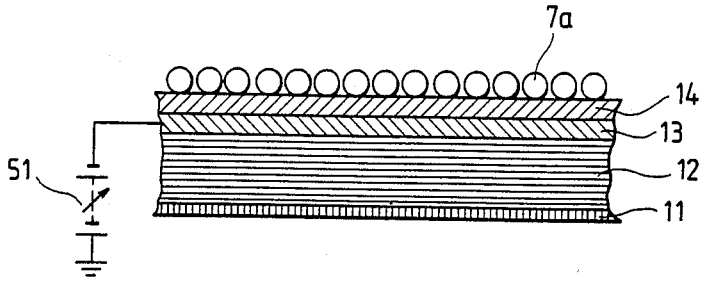
Figure 12:
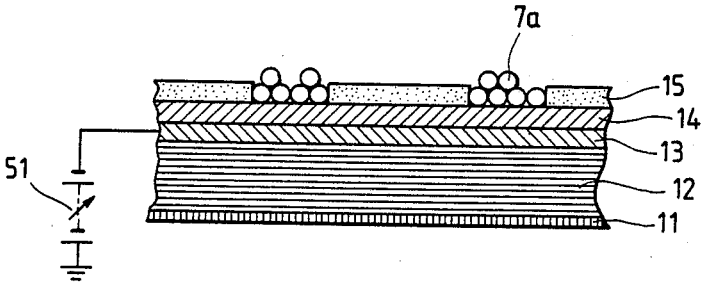

FIG. 10 is a schematic view of a print-recording apparatus related to a third embodiment of the present invention, FIG. 11 is an explanatory view showing a state in which heat-sensitive ink powder is deposited on a print-recording ink carrier, and FIG. 12 is an explanatory view showing a state in which heat-sensitive ink powder is deposited on traces of transferred ink in the heat-sensitive ink layer in the print-recording ink carrier.

In FIG. 10, the reference numeral 1*a* designates a print-recording ink carrier which is, as shown in FIGS. 11 and 12, composed of an anisotropic electrically conductive layer 11, a heating resistor layer 12, and an electrically conductive layer 13. At the time of print-recording, a heat-melting ink layer 15 is formed on the ink parting layer 14. In this third embodiment, items corresponding to those in the above first and second embodiments are referenced correspondingly and the description about them is omitted here.

In FIG. 10, the reference numeral 5 designates a return-circuit contact roll which is arranged to be brought into contact with the electrically conductive layer exposed at a side end of the print-recording ink carrier to thereby supply a bias voltage from an electric source 51. The reference numeral 6 designates a pair of feed rolls for feeding the print-recording ink carrier 1*a*. The reference numeral 7 designates a powder ink supply unit which has an electric source 72 for supplying a bias voltage to an ink feed roll 71 arranged to be opposite to the print-recording ink carrier 1*a*.

In the print-recording apparatus having the aforementioned configuration, the print-recording ink carrier 1*a* is fed to a print-recording portion by the pair of feed rolls 6. The heat- melting ink layer 15 on the print-recording ink carrier 1*a* is transferred to the transfer material 3 in response to a signal current generated from the print-recording head 2, so that print-recording is carried out. After the print-recording, the print-recording ink carrier 1*a* is fed to the powder ink supply unit 7 to regenerate the heat-melting ink layer 15. For example, the powder ink supply unit 7 is constituted by a powder ink feed roll having an electrically conductive sleeve. A bias voltage from the electric source 72 is applied to the sleeve. On the other hand, a bias voltage having the polarity reverse to the voltage applied to the sleeve is applied to the electrically conductive layer 13 of the print-recording ink carrier la by the electric source 51. Accordingly, the insulating heat-melting ink powder 7*a* fed by the powder feed roll is electrostatically moved to an exposed portion of the ink parting layer 14 as traces of transferred ink because the ink powder is charged electrically (Refer to FIG. 12).

Then, the print-recording ink carrier 1*a* is heated and pressed in the ink surface-shaping unit 8, so that thus regeneration of the heat-melting ink layer formed thereon is perfected.

In this embodiment, a bias voltage is applied to the electrically conductive layer 13 of the print-recording ink carrier 1*a* as described above. Further, the insulating ink parting layer 14 exists thereon. Accordingly, the insulating heat-melting ink powder particles electrically charged by the bias voltage applied to the ink supply carrier is free from charge leakage, so that stable ink transfer is carried out. In the case where traces of transferred ink exist, ink is selectively moved to the traces of transferred ink. Because the bias voltage to the electrically conductive layer can be adjusted suitably, the quantity of deposited heat-melting ink powder can be adjusted easily.

EMBODIMENT III-1

An 8000Å-thick Cr layer was formed by applying Cr to one surface of an electrically conductive polyimide film having surface resistivity of 430 Ω/□ and a thickness of 35 μm by a high-frequency sputtering film-forming method. Then, a photo-resist was formed on the Cr layer and then subjected to a pre-baking process at 90° C. for 7 minutes to thereby prepare a 1.0 μm-thick resist film. The resist film was exposed to light through a pattern of 15 μm-square dots at intervals of a pitch 20 μm on its whole surface, developed, washed with water and then heated at 120° C. for 15 minutes in an oven under an $N_2$ atmosphere to thereby be hardened. Then, etching was carried out by using hydrochloric acid to remove the Cr layer partly from a portion not covered with the photo-resist film. Then, the resulting film was washed well with water, put in an acetone bath and cleaned further well with ultrasonic wave to remove the resist film. Thus, an anisotropic electrically conductive layer having a Cr pattern of 15 μm-square dots at intervals of a pitch 20 μm on its whole one-side surface was prepared.

Then, an 800Å-thick electrically conductive layer (surface resistivity: 0.6 Ω/□) was formed by applying Al to the other surface of the electrically conductive polyimide film by the high-frequency sputtering film-forming method. Thermosetting silicone hard-coat resin was applied onto the Al layer and hardened by heating at 150° C. for 2 hours to thereby prepare an ink parting layer having a volume resistivity of $10^{15}$ Ω cm, a critical surface tension of 34 dyne/cm, a thickness of 0.3 μm and a heat-resisting temperature of 290° C. In the application of the resin, the ink parting layer was not formed in opposite belt ends of the film in order to provide a return-circuit contact therein.

The film-shaped matter thus prepared was stuck while the anisotropic electrically conductive layer being turned inward to thereby prepare an endless belt.

Then, a 7 μm-thick heat-melting ink layer containing 7% by weight of pigment dispersed in low-molecular polyester resin (melting point: 97° C., glass transition point: 61° C.) was formed on the ink parting layer.

The print-recording ink carrier having the coloring heat-melting ink layer as described above was mounted on a print-recording apparatus as shown in FIG. 10 to carry out the following test.

A print-recording head having 10 μm-high circular prominent electrically conductive portions arranged in the rate 8/mm (pitch: 125 μm, diameter: 75 μm) within a width of 210 mm was used in the test. The print-recording ink medium was fed at a linear speed of 120 mm/sec under application of pressure of 600 g/cm and pulses with the pulse duty-factor of 100% and the pulse period of 650 μs/dot to carry out a print-recording.

The heat-melting ink power used in this embodiment was prepared by the steps of: dispersing 7% by weight of pigment in low-molecular polyester resin (melting point: 97° C., glass transition point: 61° C.) as a base material; grinding the resulting mixture by a jet mill; and classifying the resulting mixture to obtain powder with a mean particle diameter of 9.3 μm.

The heat-melting ink powder was mixed well with an insulating coat carrier made of iron powder with a mean particle diameter of 130 μm. Then the mixture was supplied onto a powder ink feed roll having an electrically conductive sleeve (diameter: 30 μm) and 6 poles of bar-like magnetite in its inside.

The sleeve of the powder ink feed roll was rotated at a linear speed of 420 mm/sec in the direction reverse to the print-recording ink carrier. A bias voltage of −400 V was applied to the sleeve while the distance between the surface of the sleeve and the print-recording ink carrier was established to be 1.8 mm. On the other hand, a bias voltage of +200 V was applied to the electrically conductive layer of the print-recording ink carrier.

Thus, the heat-melting ink powder was supplied to the traces of transferred ink.

Then, a pressure of 1.0 kg/cm was applied to the heat-melting ink powder heated at 120° C. in the ink surface-shaping process so that the surface of the heat-melting ink layer was shaped like a flat surface to thereby perfect regeneration.

The aforementioned series of procedure for print-recording and reproduction of the ink layer was repeated by 100 times. As a result, good-quality images could be attained continuously.

COMPARATIVE EXAMPLE III-a

A print-recording ink carrier was prepared in the same manner as in Embodiment III-1 except that the ink parting layer in Embodiment III-1 was not provided in Comparative Example III-a. The print-recording ink carrier was estimated in the same manner as in Embodiment III-1. As a result, broken narrow lines appeared in the first-time transfer image. In short, the quality of the image was poor. After the second time, the transferred heat-melting ink powder was so uneven that the regenerated heat-melting ink layer was uneven. Accordingly, both the quality of the image and the level of regeneration were poor. Furthermore, the Al layer as an electrically conductive layer was severely worn out by contact between the magnetic brush containing heat-melting ink powder and the surface of the print-recording ink carrier. Accordingly, the Al layer was worn out so severely that the silver white color thereof could not observed by eyes at 500-time repetition.

COMPARATIVE EXAMPLE III-b

A print-recording ink carrier was prepared in the same manner as in Embodiment III-1, except that the thickness of the ink parting layer was established to be 8 μm in the Comparative Example. The print-recording ink carrier was estimated in the same manner as in Embodiment III-1. As a result, the heat-melting ink powder could not selectively be deposited on the traces of transferred ink. In short, the ink was deposited on the whole surface to form a thin film, so that the heat-melting ink layer could not be regenerated.

COMPARATIVE EXAMPLE III-c

A print-recording ink carrier was prepared in the same manner as in Embodiment III-1 except that the thickness of the ink parting layer was established to be 0.05 μm in the Comparative Example. As a result, a large number of pinholes occurred in the ink parting layer. The ink carrier was estimated in the same manner as in Embodiment III-1. As a result of the estimation, irregularity occurred in transfer of the heat-melting ink powder so that the quality of the image was poor.

EMBODIMENT III-2

A print-recording ink carrier was prepared in the same manner as in Embodiment III-1 except that the heat-melting ink layer was not provided on the ink parting layer in this Comparative Example. The heat-melting ink powder was transferred onto the ink parting layer in the same manner as in Embodiment III-1. As a result, the mean thickness of the heat-melting ink layer was 6 μm. The deviation Ra thereof was 1.6 μm. In short, there was no problem in the quality of the image produced by print-recording.

In this embodiment, the heat-melting ink layer is formed or regenerated by the steps of: applying a voltage between the electrically conductive layer of the print-recording ink carrier and the ink supply carrier; and then moving the electrically conductive ink powder charged on the ink supply carrier onto the ink parting layer. Accordingly, the heat-melting ink is deposited stably and uniformly. Further, the electrically conductive ink powder is selectively deposited on a portion free from the heat-melting ink layer though the portion free from the heat-melting ink layer may coexist with a portion coated with the heat-melting ink layer on the ink parting layer. In addition, the quantity of deposited heat-melting ink powder can be adjusted easily by changing the bias voltage applied to the electrically conductive layer.

What is claimed is:

1. A method for regenerating an ink recording medium formed by successively laminating an anisotropic electrically conductive layer, a heating resistor layer for generating heat in response to application of an electric signal, an electrically conductive layer, an ink parting layer having a thickness of 0.08 to 3 μm and a volume resistivity of $10_8$ Ω cm or more, and a heat-melting ink layer, in which said heat-melting ink layer after print-recording with said ink recording medium is regenerated by use of ink particles containing a binding resin and a coloring agent, said method comprising the steps of:

electrifying said heat-melting ink layer after print-recording with said ink recording medium with the same polarity as the potential of electrified ink particles; and depositing said ink particles carried by an ink carrier on traces of transferred ink formed in said heat-melting ink layer.

2. A method for regenerating an ink recording medium according to claim 1, in which a bias voltage is applied between said powder ink carrier and said electrically conductive layer of said ink recording medium.

3. A method for regenerating an ink recording medium according to claim 1, in which the electrification of said heat-melting ink layer is performed by means of a corona discharger.

4. A method for regenerating an ink recording medium according to claim 1, in which said ink parting layer in said ink recording medium has a critical surface tension of 38 dyne/cm or less and heat resistance against a temperature of 180° C. or more.

5. A method for regenerating an ink recording medium according to claim 1, in which said electrically conductive layer in said ink recording medium has a surface resistivity of 50 Ω/□ or less.

6. A method for regenerating an ink recording medium formed by successively laminating an anisotropic electrically conductive layer, a heating resistor layer for generating heat in response to application of an electric signal, an electrically conductive layer, an ink parting layer, and a heat-melting ink layer, in which said heat-melting ink layer after print-recording with said ink recording medium is regenerated by use of heat-melting ink powder, said method comprising the steps of:

supplying heat-melting ink powder onto said ink parting layer of said ink recording medium;

bringing an electrically energizing means into contact with said anisotropic electrically conductive layer of said ink recording medium over the whole width thereof; and applying a voltage and pressure between said electrically energizing means and said electrically conductive layer of said ink recording medium to thereby shape the surface of said heat-melting ink layer.

7. A method for regenerating an ink recording medium according to claim 6, in which said electrically energizing means is constituted by an electrode roll having at least one electrically conductive layer on its surface.

8. A method for supplying heat-melting ink powder, to a print-recording ink carrier formed by successively laminating an anisotropic electrically conductive layer, a heating resistor layer for generating heat in response to application of an electric signal, an electrically conductive layer, and an ink parting layer having a volume resistivity of $10^8$ Ω cm or more and a thickness of 0.08 to 3.0 μm, said method comprising the steps of:

facing said print-recording ink carrier to a supply ink carrier carrying insulating heat-melting ink powder on its surface so that said ink parting layer of said print-recording ink carrier comes into close or direct contact with said supply ink carrier;

applying a voltage between said conductive layer of said print-recording ink carrier and said supply ink carrier; and transferring said heat-melting ink powder onto said ink parting layer.

9. A method for supplying heat-melting ink powder according to claim 8, in which said ink parting layer has heat resistance against a temperature of 180° C. or more and a critical surface tension of 38 dyne/cm or less.

* * * * *

UNITED STATES PATENT AND TRADEMARK OFFICE

CERTIFICATE OF CORRECTION

PATENT NO. : 4,976,986

DATED : December 11, 1990

INVENTOR(S) : EIICHI AKUTSU ET AL.

It is certified that error appears in the above-identified patent and that said Letters Patent is hereby corrected as shown below:

Abstract, 2nd. column, line 7, change "agent, the" to --agent. The--.

Abstract, 2nd. column, line 7, The --,

Abstract line 15 change "is" to --are--.

Claim 1, column 16, line 22, change "$10_8$" to --$10^8$--.

Signed and Sealed this

Twelfth Day of January, 1993

*Attest:*

DOUGLAS B. COMER

*Attesting Officer*

*Acting Commissioner of Patents and Trademarks*